US006481487B2

(12) United States Patent
Simon

(10) Patent No.: US 6,481,487 B2
(45) Date of Patent: Nov. 19, 2002

(54) GUIDANCE DEVICE FOR A FLEXIBLE CURTAIN DOOR

(76) Inventor: Bernard Simon, 20 Chem JB Gailliard, Caluire et Cuire 69300 (FR)

( * ) Notice: Subject to any disclaimer, the term of this patent is extended or adjusted under 35 U.S.C. 154(b) by 0 days.

(21) Appl. No.: 09/765,586

(22) Filed: Jan. 22, 2001

(65) Prior Publication Data

US 2002/0124972 A1 Sep. 12, 2002

Related U.S. Application Data

(63) Continuation of application No. 09/402,487, filed as application No. PCT/FR98/00763 on Apr. 16, 1998, now Pat. No. 6,192,960.

(30) Foreign Application Priority Data

Apr. 23, 1997 (FR) ..... 97 05305

(51) Int. Cl.[7] ..... A47H 5/00

(52) U.S. Cl. ..... 160/84.06; 160/264; 160/277

(58) Field of Search ..... 160/84.01, 84.06, 160/270, 271, 272, 274, 277, 278, 266

(56) References Cited

U.S. PATENT DOCUMENTS

| | | | | |
|---|---|---|---|---|
| 422,292 | A | | 2/1890 | Chase |
| 449,042 | A | | 3/1891 | Haswell |
| 471,114 | A | | 3/1892 | Haswell |
| 767,909 | A | | 8/1904 | Miller |
| 1,169,803 | A | | 2/1916 | Greenberg |
| 1,434,882 | A | | 11/1922 | Flagg |
| 1,807,769 | A | | 6/1931 | Wileman |
| 2,240,416 | A | | 4/1941 | Pidgeon |
| 2,318,525 | A | * | 5/1943 | Renton |
| 3,465,806 | A | | 9/1969 | Sulkes |
| 4,016,920 | A | * | 4/1977 | Shepard |
| 4,934,437 | A | | 6/1990 | Kraeutler |
| 5,141,043 | A | | 8/1992 | Kraeutler |
| 5,183,093 | A | | 2/1993 | Kraeutler |
| 5,219,015 | A | | 6/1993 | Kraeutler |
| 5,291,931 | A | | 3/1994 | Kraeutler |
| 5,379,823 | A | | 1/1995 | Kraeutler |
| 5,887,385 | A | * | 3/1999 | Horner et al. |
| 5,937,929 | A | | 8/1999 | Chen |
| 6,192,960 | B1 | * | 2/2001 | Simon |

FOREIGN PATENT DOCUMENTS

| | | |
|---|---|---|
| DE | 1148049 | 5/1963 |
| DE | 3743366 | 7/1989 |
| EP | 0398791 | 11/1990 |
| EP | 0688936 | 12/1995 |
| EP | 0587586 | 3/1997 |
| FR | 1569966 | 6/1969 |
| FR | 2545871 | 11/1984 |

* cited by examiner

*Primary Examiner*—Blair M. Johnson

(57) ABSTRACT

Guidance device for guiding a flexible curtain in an opening, the guidance device including a first guideway for mounting to a jam of the opening. The first guideway includes at least two straps defining a space therebetween, at least one of the two straps being stretched between at least two points on the jam. A second guideway is mounted to another jam of the opening, the second guideway comprising at least two straps defining a space therebetween. At least one of the two straps being stretched between at least two points on the jam, wherein the first and second guideways are adapted to flexibly guide the flexible curtain within the opening.

107 Claims, 8 Drawing Sheets

GUIDANCE DEVICE FOR A FLEXIBLE CURTAIN DOOR

CROSS-REFERENCE TO RELATED APPLICATIONS

The present application is a continuation of U.S. application Ser. No. 09/402,487, filed Apr. 16, 1998, now U.S. Pat. No. 6,192,960, which is a National Stage Application of International Application No. PCT/FR98/00763, filed Apr. 16, 1998, not published under PCT Article 21(2) in English. The disclosures of the above listed applications are expressly incorporated by reference herein in their entireties. Further, the present application claims priority of French Application No. 97/05305, filed Apr. 23, 1997.

BACKGROUND OF THE INVENTION

1. Field of the Invention

This invention relates to a guidance device for a flexible curtain containing horizontal cross-pieces forming the panel of a motor-driven flexible curtain door, allowing the panel to be moved quickly between a closed position and an open position.

The guidance device in this invention is intended in particular for doors in which the flexible curtain is either rolled around a drum or folded, concertina-style, in a given space.

2. Description of Background and Relevant Information

There are known flexible curtain doors which have two vertical, parallel metal supports in a U or C shape which can be fitted either directly into a concrete frame on which the door is fitted, or via elastic components placed between the vertical jambs of the concrete frame and the metal supports, as described in European Patent Application No. 92 909384 (i.e., EP 0 587 586).

Each metal support receives a straight guidance path in which the lateral edges of the flexible curtain run when it is moved between a closed position and an open position.

The guidance paths are made from channel in which a slideway is placed to guide the lateral edges of the curtain in each direction. Each guidance path includes a slideway whose internal profile is roughly square, with one edge having a slot running the full height of the guidance path for the curtain to pass along.

The guidance paths are made of a semi-elastic material, so that when a pulling force is exerted on the curtain, the lateral edges of the curtain are released from the guidance paths.

This type of flexible curtain door has certain problems in that it is impossible to have access to and to clean the internal walls of the slideways fitted in each guidance path. When these doors are installed in rooms where food products are processed, it is essential to clean the door, and in particular the guidance paths completely after each day's work. The structure of the guidance paths described above means that this procedure is impossible without completely dismantling the door.

In addition, the guidance paths have very low resistance to impact, since the semi-elastic material of which the section is made is weakened by the slot made along its full height.

Slideways are more traditionally made of an open, U-shaped section the width across which is identical from top to bottom, a solution which is unsuitable for the way in which these doors operate.

Thus for concertina-style flexible curtain doors, these slideways have made it necessary to accommodate, when the door is open, a significant volume of stacked slats, while the passage that is necessary and sufficient in the closed position is limited to the thickness of the door.

Similarly, for roll-up doors, the curtain shifts in its vertical plane because of the change in the diameter of the roller curtain, depending on whether it is in the open or closed position. It is therefore recommended that the upper part of the slideway should be wider, to allow the panel to drop without restriction and without friction.

SUMMARY OF THE INVENTION

The guidance device in the invention includes, on the vertical and opposite jambs of a flexible curtain door, straps which are arranged opposite each other to form a guideway on each jamb for the horizontal cross-pieces, with the straps each being stretched and fixed between two end points built into the corresponding jamb to allow each strap, when subjected to an external force, to deform elastically and return undamaged to its original position.

The guidance device according to at least one embodiment of this invention has on each jamb of the door two straps with a sloping part to provide accommodation space for the flexible curtain, and a straight-vertical part so that the straps are parallel with each other to guide the curtain in its vertical movements between a closed position and an open position.

The guidance device may also provide that each strap has, between a holding pin and a stop, a sloping part to form, with the other strap, a V-shaped space to accommodate the unwinding of the flexible curtain of a roll-up door when it is blocked in its descent by an obstacle.

The guidance device may also provide that each strap has, between a holding pin and a stop, a first sloping part, and between the stop and another midway stop a second sloping part to form, with the other strap, a graduated opening space to accommodate the folds of the flexible curtain of a concertina-style door, when it is closed.

The invention may include straps, the width of each of which is dependent on that of the flexible curtain of the door.

The guidance device may utilize stops against which the straps bear so that the line of each strap is defined along its whole length.

The guidance device may have, between two straps on a jamb of the door, and especially in the straight vertical part of these, a distance "d" close to that of the thickness of the flexible curtain.

The invention may provide that the guidance device has straps, each of which is able, when subjected to an external force, to deform elastically, on the one hand around its vertical axis, and on the other hand perpendicularly to its vertical axis, and to return undamaged to its original position.

The invention may also provide for a flexible curtain door that includes vertical and opposite jambs on which are fixed straps which are arranged opposite each other to form a guideway on each jamb for the horizontal cross-pieces of the flexible curtain, with the straps each being stretched and fixed between two end points, built into the jambs to allow each strap, when subjected to an external force, to deform elastically and return undamaged to its original position.

The invention further provides for a device for guiding a curtain in an opening, the device comprising a first guideway mounted to a first jamb adjacent the opening. The first guideway comprises a space adapted to receive a portion of the curtain and at least one elastically deformable member which is arranged between at least two points on the first jamb. A second guideway is mounted to a second jamb adjacent the opening. The second guideway comprises a space adapted to receive a portion of the curtain and at least one elastically deformable member which is arranged between at least two points on the second jamb. The first and second guideways flexibly guide the curtain within the space of the guideways.

At least one of the elastically deformable members may be oriented generally vertically. At least one of the elastically deformable members may be adapted to deform elastically and return undamaged to an original position. At least one of the elastically deformable members may be adapted to deform elastically perpendicularly to one of a corresponding first and second jambs and to return to an original position. At least one of the elastically deformable members may comprise an elastic strap. At least one of the elastically deformable members may be stretched between the at least two points. At least one of the first and second guideways may be adapted to guide side portions of the curtain within the space of the respective first and second guideways.

The invention provides for a device for guiding a curtain in an opening, the device comprising a first guideway mounted to a first jamb adjacent the opening. The first guideway comprises at least two members defining a space therebetween and is adapted to receive a portion of the curtain. At least one of the two members of the first guideway is an elastically deformable member arranged between at least two points on the first jamb. A second guideway is mounted to a second jamb adjacent the opening. The second guideway comprises at least two members defining a space therebetween and which is adapted to receive a side portion of the curtain. At least one of the two members of the second guideway is an elastically deformable member arranged between at least two points on the second jamb. The first and second guideways flexibly guide side portions of the curtain within the space of the guideways.

The at least one of the elastically deformable members may be oriented generally vertically. The at least one of the elastically deformable members may be adapted to deform elastically and return undamaged to an original position. The at least one of the elastically deformable members may be adapted to deform elastically perpendicularly to a corresponding one of the first and second jambs. Each of the first and second guideways may be mounted to an inside surface of the respective first and second jambs. Each of the elastically deformable members may be stretched between at least two points on corresponding first and second jambs. Each of the elastically deformable members may comprise a strap which is stretched between at least two points on corresponding first and second jambs.

The invention provides for a device for guiding a curtain in an opening, the curtain including at least one horizontal cross piece with opposed ends. The device comprises a first guideway mounted to a first vertical jamb adjacent the opening. The first guideway comprises a space adapted to receive an end of the horizontal cross piece and at least one elastically deformable member arranged between at least two points on the first vertical jamb. A second guideway is mounted to a second vertical jamb adjacent the opening. The second guideway comprises a space adapted to receive an end of the horizontal cross piece and at least one elastically deformable member arranged between at least two points on the second vertical jamb. The first and second guideways flexibly guide the ends of the at least one horizontal cross piece within the space of the guideways.

Each of the elastically deformable members may have an original position corresponding to a vertical axis, and, when subjected to external force, each is able to deform elastically with respect to the vertical axis and to return undamaged to the original position. When subjected to an external force, each of the elastically deformable members may be able to deform elastically perpendicularly to the vertical axis, and return undamaged to the original position. Each of the elastically deformable members may comprise a strap. Each strap may be stretched between at least two points on the first and second jambs.

The invention provides for a device for guiding a curtain in an opening, the curtain including at least one horizontal cross piece with opposed ends. The device comprises a first guideway mounted to a first vertical jamb adjacent the opening. The first guideway comprises at least two members defining a space therebetween and is adapted to receive an end of the horizontal cross piece. At least one of the two members of the first guideway comprises an elastically deformable member arranged between at least two points on the first vertical jamb. A second guideway is mounted to a second vertical jamb adjacent the opening. The second guideway comprises at least two members defining a space therebetween and adapted to receive an end of the horizontal cross piece. At least one of the two members of the second guideway comprises an elastically deformable member arranged between at least two points on the second vertical jamb. The first and second guideways flexibly guide the ends of the horizontal cross piece within the space of the guideways within the door opening.

Each of the elastically deformable members may have an original position corresponding to a vertical axis, and, when subjected to an external force, each is able to deform elastically with respect to the vertical axis and to return undamaged to the original position. When subjected to an external force, each of the elastically deformable members may be able to deform elastically perpendicularly to the vertical axis, and return undamaged to the original position. Each of the elastically deformable members may comprise a strap.

The invention provides for a device for guiding a curtain in an opening, the device comprising a first guideway mounted to a first jamb adjacent the opening. The first guideway comprises a space adapted to receive a portion of the curtain and at least one strap which is arranged between at least two points on the first jamb. A second guideway is mounted to a second jamb adjacent the opening. The second guideway comprises a space adapted to receive a portion of the curtain and at least one strap which is arranged between at least two points on the second jamb. The first and second guideways flexibly guide the curtain within the space of the guideways.

At least one of the straps may be oriented generally vertically. At least one of the straps may be adapted to deform elastically and return undamaged to an original position. At least one of the straps may be adapted to deform elastically perpendicularly to one of a corresponding first and second jambs and to return to an original position. At least one of the straps may comprise an elastic strap. At least one of the straps may be stretched between the at least two points. At least one of the first and second guideways may be adapted to guide side portions of the curtain within the space of the respective first and second guideways.

The invention provides for a device for guiding a curtain in an opening, the device comprising a first guideway mounted directly to an inside surface of a first jamb adjacent the opening. The first guideway comprises at least two members defining a space therebetween and adapted to receive a portion of the curtain. At least one of the two members of the first guideway may comprise a strap. A second guideway is mounted directly to an inside surface of a second jamb adjacent the opening. The second guideway may comprise at least two members defining a space therebetween and adapted to receive a side portion of the curtain. At least one of the two members of the second guideway may comprise a strap. The first and second guideways may flexibly guide side portions of the curtain within the space of the guideways. Each of the straps may be generally vertically oriented and is adapted to deform elastically and return undamaged to an original position. Each of the straps may be adapted to deform elastically perpendicularly to one of the first and second jambs. Each of the straps may be stretched between at least two points mounted to each corresponding first and second jambs. Each of the straps may be stretched between at least two points on corresponding first and second jambs.

The invention provides for a device for guiding a curtain in an opening, the curtain including at least one horizontal cross piece with opposed ends, the device comprising a first guideway mounted to a first vertical jamb adjacent the opening. The first guideway comprises a space adapted to receive an end of the horizontal cross piece and at least one strap arranged between at least two points on the first vertical jamb. A second guideway is mounted to a second vertical jamb adjacent the opening. The second guideway comprises a space adapted to receive an end of the horizontal cross piece and at least one strap arranged between at least two points on the second vertical jamb. The first and second guideways may flexibly guide the ends of the at least one horizontal cross piece within the space of the guideways.

Each of the straps may have an original position corresponding to a vertical axis, and, when subjected to external force, each is able to deform elastically with respect to the vertical axis and to return undamaged to the original position. When subjected to an external force, each of the straps is able to deform elastically perpendicularly to the vertical axis, and return undamaged to the original position. Each of the straps may comprise an elastic strap. Each strap may be stretched between at least two points on the first and second jambs.

The invention provides a device for guiding a curtain in an opening, the curtain including at least one horizontal cross piece with opposed ends, the device comprising a first guideway mounted directly to an inside surface of a first jamb adjacent the opening. The first guideway comprises at least two members defining a space therebetween and adapted to receive a portion of the curtain. At least one of the two members of the first guideway comprises a strap. A second guideway is mounted directly to an inside surface of a second jamb adjacent the opening. The second guideway comprises at least two members defining a space therebetween and adapted to receive a side portion of the curtain. At least one of the two members of the second guideway comprises a strap. The first and second guideways flexibly guide the ends of the at least one horizontal cross piece within the space of the guideways.

Each of the straps may be generally vertically oriented and is adapted to deform elastically and return undamaged to an original position. Each of the straps may be adapted to deform elastically perpendicularly to one of the first and second jambs. Each of the straps may be stretched between at least two points mounted to each corresponding first and second jambs. Each of the straps may comprise a strap which is stretched between at least two points on corresponding first and second jambs.

The invention provides for a device for guiding a curtain in a door opening, the curtain including opposed side portions and being movable generally vertically between at least a blocked position and at least an unblocked position relative to the door opening which includes vertical edges, the device comprising at least two members extending generally vertically and defining a space therebetween and being mountable adjacent a vertical edge of the door opening. The space is adapted to receive a side portion of the curtain such that the two members guide the curtain between the blocked and unblocked positions. At least one of the two members has an original position and is elastically deformable so as to deform and allow the side portion of the curtain to escape from the space upon application of a lateral impact on the curtain, and to return undamaged to the original position.

Each of the at least two members may be elastically deformable. At least one of the two members may comprise a strap. Each of the two members may comprise an elastically deformable strap. The original position may correspond to a vertical axis, and when the at least one of the two members is subjected to an external force, it is able to deform elastically around the vertical axis and return undamaged to the original position. The at least one of the two members may be subjected to an external force, is able to deform elastically perpendicularly to the vertical axis and return undamaged to the original position. Each of the two members may include an original position corresponding to a vertical axis, such that when one of the two members is subjected to an external force, it is able to deform elastically perpendicularly to the vertical axis and to return undamaged to the original position.

The invention provides for a device for guiding a curtain in a door opening, the curtain including at least one horizontal cross piece with opposed ends, the curtain being movable generally vertically between at least blocking and unblocking positions relative to the door opening which includes vertical edges, the device comprising at least two members extending generally vertically and mountable adjacent a vertical edge of the door opening. The at least two members are disposed to provide a space therebetween. The space is adapted to receive an end of the horizontal cross piece to guide the curtain between at least the blocking and the unblocking positions. At least one of the two members may have an original position and is elastically deformable so as to deform and allow the end of the horizontal cross piece to escape from the space upon application of a lateral impact on the curtain, and to return undamaged to the original position.

Each of the at least two members may be elastically deformable. At least one of the two members may comprise a strap. Each of the two members may comprise a strap. The original position may correspond to a vertical axis, and when the at least one of the two members is subjected to an external force, it is able to deform elastically around the vertical axis and return undamaged to the original position. When the at least one of the two members is subjected to an external force, it is able to deform elastically perpendicularly to the vertical axis and return undamaged to the original position. At least one of the two members may include an original position corresponding to a vertical axis, such that when one of the two members is subjected to an external force, it is able to deform elastically perpendicularly to the vertical axis and return undamaged to an original position.

The invention provides for a device for guiding a door, the door including opposed side portions and being movable generally vertically between at least blocking and unblocking positions relative to a door opening including vertical edges, the device comprising at least two members extending generally vertically and mountable adjacent a vertical edge of the door opening and which are disposed to provide a space therebetween, the space being adapted to receive a side portion of the door such that the members guide the door between at least the blocking and the unblocking positions. At least one of the members has an original position and is elastically deformable so as to deform and allow the side portion of the door to escape from the space upon application of a lateral impact on the door, and to return undamaged to an original position.

Each of the at least two members may be elastically deformable. At least one of the two members comprises a strap. Each of the two members may comprise a strap. The original position may correspond to a vertical axis, and when the at least one of the two members is subjected to an external force, it is able to deform elastically around the vertical axis and to return undamaged to the original position. When the at least one of the two members is subjected to an external force, it is able to deform elastically perpendicularly to the vertical axis and to return undamaged to the original position. Each of the two members may include an original position corresponding to a vertical axis, such that when one of the two members is subjected to an external force, it is able to deform elastically perpendicularly to the vertical axis and to return undamaged to the original position.

The invention provides for a curtain door utilizing a guidance device for guiding a curtain in an opening. The curtain door comprises a curtain including side portions and movable within the opening. A first guideway is mounted to a first vertical jamb adjacent the opening. The first guideway includes a space adapted to receive a portion of the flexible curtain, and comprising at least one elastically deformable member arranged between at least two points on the first vertical jamb. A second guideway is mounted to a second vertical jamb adjacent the opening. The second guideway includes a space adapted to receive a portion of the flexible curtain, and comprising at least one elastically deformable member arranged between at least two points on the second vertical jamb. The first and second guideways are each adapted to flexibly guide the flexible curtain within the opening.

Each of the elastically deformable members has an original position corresponding to a vertical axis, and, when subjected to an external force, each is able to deform elastically around the vertical axis and to return undamaged to the original position. When subjected to an external force, each of the elastically deformable members is able to deform elastically perpendicularly to the vertical axis, and return undamaged to the original position. Each of the elastically deformable members may comprise a strap, and wherein each strap has an original position corresponding to a vertical axis, and, when subjected to external force, each is able to deform elastically perpendicularly to the vertical axis and to return undamaged to the original position.

The invention provides for a curtain door utilizing a guidance device for guiding a curtain in an opening, the curtain door comprising a curtain including side portions and being movable within the opening. A first guideway is mounted to a first vertical jamb adjacent the opening. The first guideway comprises at least two members defining a space therebetween and adapted to receive a side portion of the curtain. At least one of the two members of the first guideway is an elastically deformable member arranged between at least two points on the first vertical jamb. A second guideway is mounted to a second vertical jamb adjacent the opening. The second guideway comprises at least two members defining a space therebetween and adapted to receive a side portion of the curtain. At least one of the two members of the second guideway is an elastically deformable member arranged between at least two points on the second vertical jamb. The first and second guideways are each adapted to flexibly guide the side portions of the flexible curtain within the opening.

Each of the elastically deformable members may have an original position corresponding to a vertical axis, and, when subjected to external force, each is able to deform elastically around the vertical axis and to return undamaged to the original position. When subjected to an external force, each of the elastically deformable members is able to deform elastically perpendicularly to the vertical axis, and return undamaged to the original position. Each of the elastically deformable members may comprise a strap, and wherein each strap has an original position corresponding to a vertical axis, and, when subjected to external force, each is able to deform elastically perpendicularly to the vertical axis and to return undamaged to the original position.

The invention provides for a curtain door utilizing a guidance device for guiding a curtain in an opening, the curtain door comprising the curtain including at least one horizontal cross piece with opposed ends. A first guideway is provided for mounting to a first vertical jamb adjacent the opening. The first guideway includes a space adapted to receive an end of the horizontal cross piece, and comprising at least one elastically deformable member arranged between at least two points on the first vertical jamb. A second guideway is provided for mounting to a second vertical jamb adjacent the opening. The second guideway includes a space adapted to receive an end of the horizontal cross piece, and comprising at least one elastically deformable member arranged between at least two points on the second vertical jamb. The first and second guideways are each adapted to flexibly guide an end of the horizontal cross piece within the opening.

Each of the elastically deformable members may have an original position corresponding to a vertical axis, and, when subjected to external force, each is able to deform elastically around the vertical axis and to return undamaged to the original position. When subjected to an external force, each of the elastically deformable members is able to deform elastically perpendicularly to the vertical axis, and return undamaged to the original position. Each of the elastically deformable members may comprise a strap, and wherein each strap has an original position corresponding to a vertical axis, and, when subjected to external force, each is able to deform elastically perpendicularly to the vertical axis and to return undamaged to the original position.

The invention provides for a curtain door utilizing a guidance device for guiding a curtain in an opening, the curtain door comprising a curtain including at least one horizontal cross piece with opposed ends. A first guideway for mounting to a first vertical jamb adjacent the opening is provided. The first guideway comprises at least two members defining a space therebetween and adapted to receive an end of the horizontal cross piece. At least one of the two members of the first guideway is an elastically deformable member arranged between at least two points on the first vertical jamb. A second guideway for mounting to a second vertical jamb adjacent the opening is provided. The second guideway comprises at least two members defining a space therebetween and adapted to receive an end of the horizontal cross piece. At least one of the two members of the second guideway is an elastically deformable member arranged between at least two points on the second vertical jamb. The first and second guideways are each adapted to flexibly guide an end of the horizontal cross piece within the opening.

Each of the elastically deformable members may have an original position corresponding to a vertical axis, and, when subjected to external force, each is able to deform elastically around the vertical axis and to return undamaged to the original position. When subjected to an external force, each of the elastically deformable members is able to deform elastically perpendicularly to the vertical axis, and return undamaged to the original position. Each of the elastically deformable members may comprise a strap, and wherein each strap has an original position corresponding to a vertical axis, and, when subjected to external force, each is able to deform elastically perpendicularly to the vertical axis and to return undamaged to the original position.

The invention provides for a curtain door comprising a curtain adapted to move within a door opening. A first guideway is mounted to a first jamb adjacent the door opening. The first guideway includes a space adapted to receive a portion of the curtain, and comprising at least one strap. A second guideway is mounted to a second jamb adjacent the door opening. The second guideway includes a space adapted to receive a portion of the curtain, and comprising at least one strap. The first and second guideways are each adapted to flexibly guide the curtain within the door opening.

At least one of the straps may be oriented generally vertically. At least one of the straps may be adapted to deform elastically and return undamaged to an original position. The at least one strap may be adapted to deform elastically perpendicularly to one of the first and second jambs and an axis defined between at least two points on one of the first and second jambs. Each of the straps may be adapted to be stretched between the at least two points on corresponding first and second jambs. Each of the straps may be adapted to guide side portions of the curtain in the door opening. Each of the straps may be oriented generally vertically and wherein each of the straps is adapted to deform elastically and return undamaged to an original position.

The invention provides for a curtain door comprising a curtain including side portions and being movable within the opening. A first guideway is mounted to an inside surface of a first vertical jamb adjacent the opening. The first guideway comprises at least two members defining a space therebetween and adapted to receive a side portion of the flexible curtain. At least one of the two members of the first guideway comprises a strap. A second guideway is mounted to an inside surface of a second vertical jamb adjacent the opening. The second guideway comprises at least two members defining a space therebetween and adapted to receive a side portion of the flexible curtain. At least one of the two members of the second guideway comprises a strap. The first and second guideways are each adapted to flexibly guide the side portions of the flexible curtain within the opening.

Each of the straps may be adapted to deform elastically and return undamaged to an original position. When subjected to an external force, each of the straps is able to deform elastically perpendicularly to one of the first and second jambs, and return undamaged to the original position. Each of the straps may have an original position which corresponds to a vertical axis, and, when subjected to external force, each is able to deform elastically perpendicularly to the vertical axis and to return undamaged to an original position.

The invention provides for a curtain door comprising a curtain, including at least one horizontal cross piece with opposed ends, adapted to move within a door opening. A first guideway is mounted to a first jamb adjacent the door opening. The first guideway includes a space adapted to receive a portion of the curtain, and comprising at least one strap. A second guideway is mounted to a second jamb adjacent the door opening. The second guideway includes a space adapted to receive a portion of the curtain, and comprising at least one strap. The first and second guideways are each adapted to flexibly guide the curtain within the door opening.

At least one of the straps may be oriented generally vertically. At least one of the straps may be adapted to deform elastically and return undamaged to an original position. The at least one strap may be adapted to deform elastically perpendicularly to one of the first and second jambs and an axis defined between at least two points on one of the first and second jambs. Each of the straps may be adapted to be stretched between the at least two points on corresponding first and second jambs. Each of the straps may be adapted to guide side portions of the curtain in the door opening. Each of the straps may be oriented generally vertically and wherein each of the straps is adapted to deform elastically and return undamaged to an original position.

The invention provides for a curtain door comprising a curtain including at least one horizontal cross piece with opposed ends. A first guideway is mounted to an inside surface of a first vertical jamb adjacent the opening. The first guideway comprises at least two members defining a space therebetween and adapted to receive an end of the horizontal cross piece. At least one of the two members of the first guideway comprises a strap. A second guideway is mounted to an inside surface of a second vertical jamb adjacent the opening. The second guideway comprises at least two members defining a space therebetween and adapted to receive an end of the horizontal cross piece. At least one of the two members of the second guideway comprises a strap. The first and second guideways are each adapted to flexibly guide an end of the horizontal cross piece within the opening.

Each of the straps may have an original position corresponding to a vertical axis, and, when subjected to an external force, each is able to deform elastically around the vertical axis and to return undamaged to the original position. When subjected to an external force, each of the straps is able to deform elastically perpendicularly to the vertical axis, and return undamaged to the original position. Each of the straps may have an original position corresponding to a vertical axis, and, when subjected to external force, each is able to deform elastically perpendicularly to the vertical axis and to return undamaged to the original position.

The invention provides for a curtain door utilizing a guidance device for guiding a generally vertically movable curtain between at least a blocked position and an unblocked position relative to a door opening which includes vertical edges, the curtain door comprising at least two members extending generally vertically and mountable adjacent a vertical edge of the door opening and which are disposed to provide a space therebetween, the space being adapted to receive a side portion of the curtain to guide the curtain between the blocked and the unblocked positions. At least one of the members has an original position and is elastically deformable so as to deform and allow the side portion of the curtain to escape from the space upon application of a lateral impact on the curtain, and to return undamaged to the original position. The curtain is movable within the door opening.

Each of the at least two members may be elastically deformable. At least one of the two members may comprise a strap. Each of the two members may comprise a strap. The original position may correspond to a vertical axis, and when the at least one of the two members is subjected to an external force, is able to deform elastically around the vertical axis and return undamaged to the original position. At least one of the two members may be subjected to an external force, it is able to deform elastically perpendicularly to the vertical axis and to return undamaged to the original position. Each of the two members may include an original position corresponding to a vertical axis, such that when one of the two members is subjected to an external force, it is able to deform elastically perpendicularly to the vertical axis and return undamaged to the original position.

The invention provides a curtain door utilizing a guidance device for guiding a curtain movable generally vertically between at least blocking and unblocking positions relative to a door opening including vertical edges, the curtain door comprising a curtain including at least one horizontal cross piece with opposed ends. At least two members are extended generally vertically and mountable adjacent a vertical edge of the door opening and which are disposed to provide a space therebetween, the space being adapted to receive an end of the horizontal cross piece to guide the curtain between at least the blocking and the unblocking positions. At least one of the members has an original position and is elastically deformable so as to deform and allow the end of the horizontal cross piece to escape from the space upon application of a lateral impact on the curtain, and to return undamaged to the original position.

Each of the at least two members may be elastically deformable. At least one of the two members may comprise a strap. Each of the two members may comprise a strap. The original position may correspond to a vertical axis, and when the at least one of the two members is subjected to an external force, it is able to deform elastically around the vertical axis and to return undamaged to the original position. When the at least one of the two members is subjected to an external force, it is able to deform elastically perpendicularly to the vertical axis and to return undamaged to the original position. Each of the two members may include an original position corresponding to a vertical axis, such that when one of the two members is subjected to an external force, it is able to deform elastically perpendicularly to the vertical axis and to return undamaged to the original position.

The invention provides for a device for guiding a flexible curtain in a door opening, the flexible curtain including at least one horizontal cross piece with opposed ends, the flexible curtain being movable generally vertically between at least a blocking and an unblocking position relative to the door opening which includes vertical edges, the device comprising at least two members extending generally vertically and mountable adjacent a vertical edge of the door opening and which are disposed to provide a space therebetween, the space being adapted to receive an end of the horizontal cross piece to guide the flexible curtain between the blocking and the unblocking positions. At least one of the members has an original position and a first tension when in the original position, and exhibiting a second tension larger than the first tension upon application of a lateral impact on the flexible curtain causing the horizontal cross piece to engage the at least one vertically extending member.

The first tension may be non-zero. The device may further comprise a first jamb, wherein the at least one member is mounted to the first jamb. The at least one member may comprise a strap which is stretched between at least two points on the first jamb. The at least one member may comprise a strap which is stretched between at least two points. The at least one member may be elastically deformable about at least a horizontal axis.

BRIEF DESCRIPTION OF THE DRAWINGS

The following description, referring to the attached drawings which are given as non-restrictive examples, will enable a better understanding of the invention, its characteristics and the advantages it can provide. Thus.

DETAILED DESCRIPTION OF THE INVENTION

Figure 1:
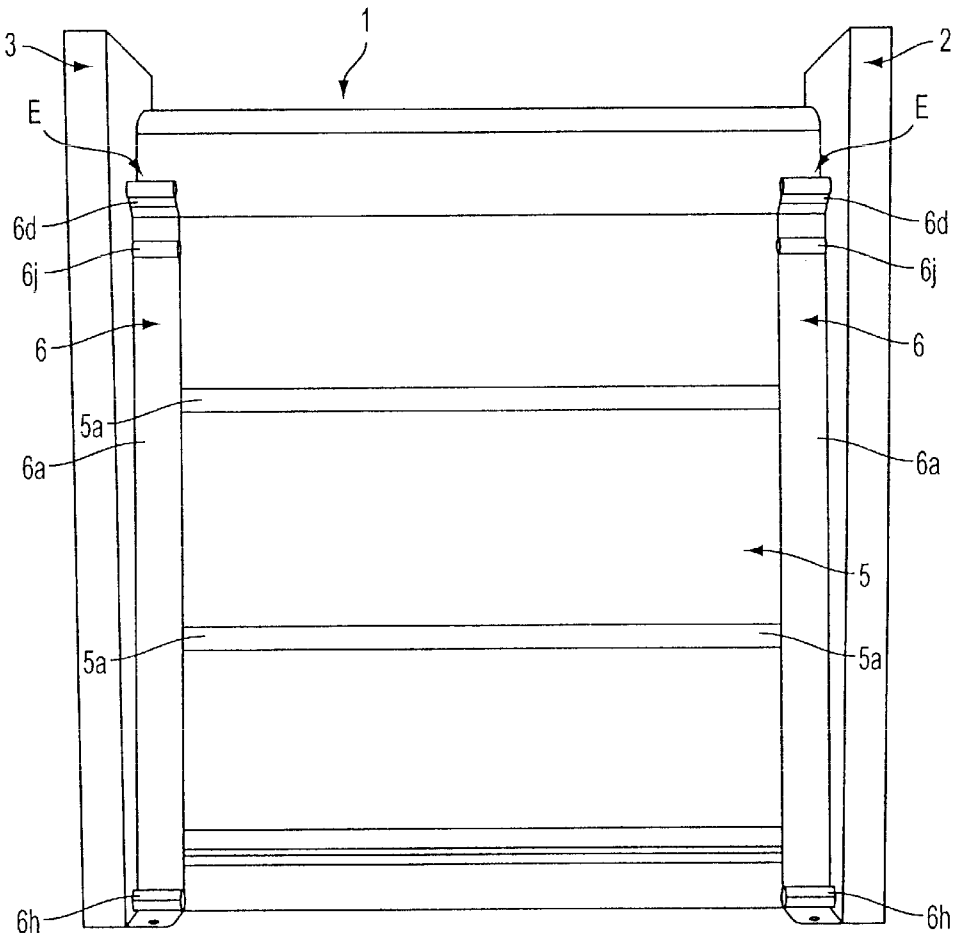
FIG. 1 shows a front view showing a flexible roll-up curtain door according to this invention.
Figure 2:
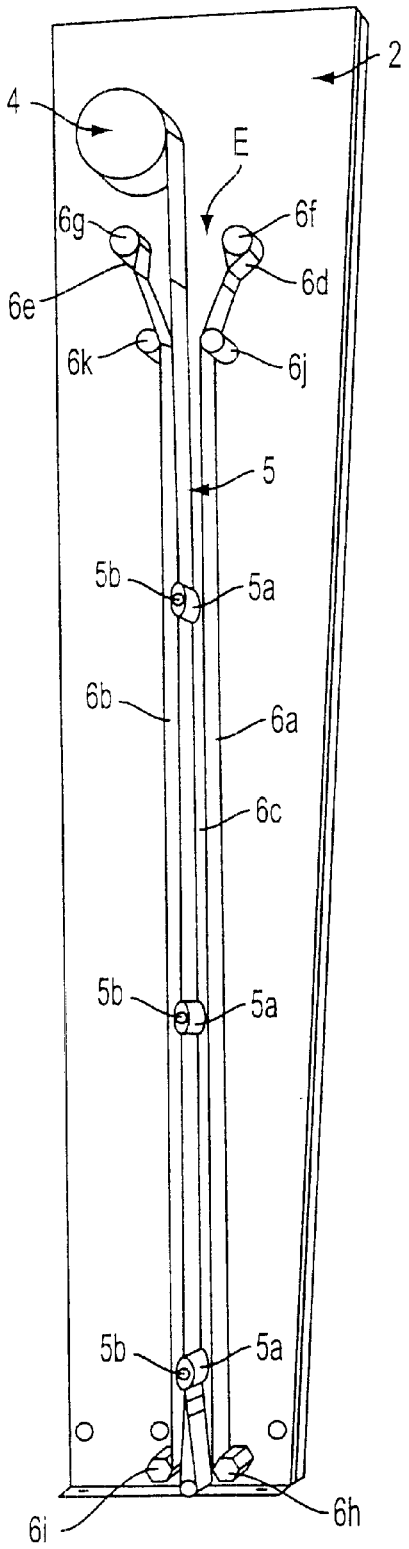
FIG. 2 shows a perspective view of a vertical jamb of the door in FIG. 1, fitted with the guidance device according to this invention.

FIGS. 1 and 2 show a door 1 including two lateral jambs 2 and 3 which are normally fixed against the vertical walls of an opening to be closed off. The opposite and vertical jambs 2 and 3 are linked together at the top by a roller drum 4 for a flexible curtain 5.

The jambs 2 and 3 have an integral guidance device 6 for the flexible curtain 5 for its movements between a closed position and an open position.

It will be observed that the flexible curtain has sleeves 5*a* in which the horizontal reinforcing cross-pieces 5*b* are inserted, their ends engaging in the guidance devices 6 fitted on each jamb 2 and 3 (FIG. 2).

Each guidance device 6 has two straps 6*a* and 6*b* fitted one opposite the other to provide on each jamb 2 and 3 a guideway 6*c* for the curtain 5 and its cross-pieces 5*b*.

For the sake of clarity and understanding, only the guidance device 6 on jamb 2 will be described, since the other fitted on jamb 3 is identical.

The straps 6*a* and 6*b* of the guidance device 6 each have at one end a loop 6*d*, 6*e* each of which fits onto an end point formed by a holding pin 6*f*, 6*g* built into the jamb 2. Holding pins 6*f* and 6*g* are arranged one opposite the other and close to the drum 4 holding the curtain 5 of the door 1.

At the bottom of jamb 2 there are two tensioners 6*h* and 6*i* forming the other ends of the guidance device which respectively hold the opposite ends to the ends with the loops 6*f* and 6*g* of the straps 6*a* and 6*b*. The tensioners 6*h* and 6*i* are both placed at the same level, and show, for example, a six-sided outside profile so that a scanner can be used to stretch each strap 6*a* and 6*b* between the two end points formed by the pins 6*f*, 6*g* and the tensioners 6*h*, 6*i*.

There are two opposite stops 6*j* and 6*k* between the two end points of the guidance device 6, against which the straps 6*a* and 6*b*, respectively, bear.

Stops 6*j* and 6*k* are arranged on the one hand, offset with respect to pins 6*f* and 6*g* and on the other, on the same vertical axis as the tensioners 6*h* and 6*i*. This configuration allows the straps 6*a* and 6*b* to include a sloping part to provide accommodation space E for the flexible curtain 5 near the drum 4, whose function will be seen later.

Straps 6*a* and 6*b* have, in the extension of the accommodation space E a straight vertical part so that the said straps are parallel with each other to guide the flexible curtain 5 in its vertical movements between a closed position and an open position.

Thus each strap 6*a* and 6*b* has a sloping part between the respective pins 6*f*, 6*g* and the stops 6*d*, 6*k* to form space E which is more particularly V-shaped.

Figure 3:
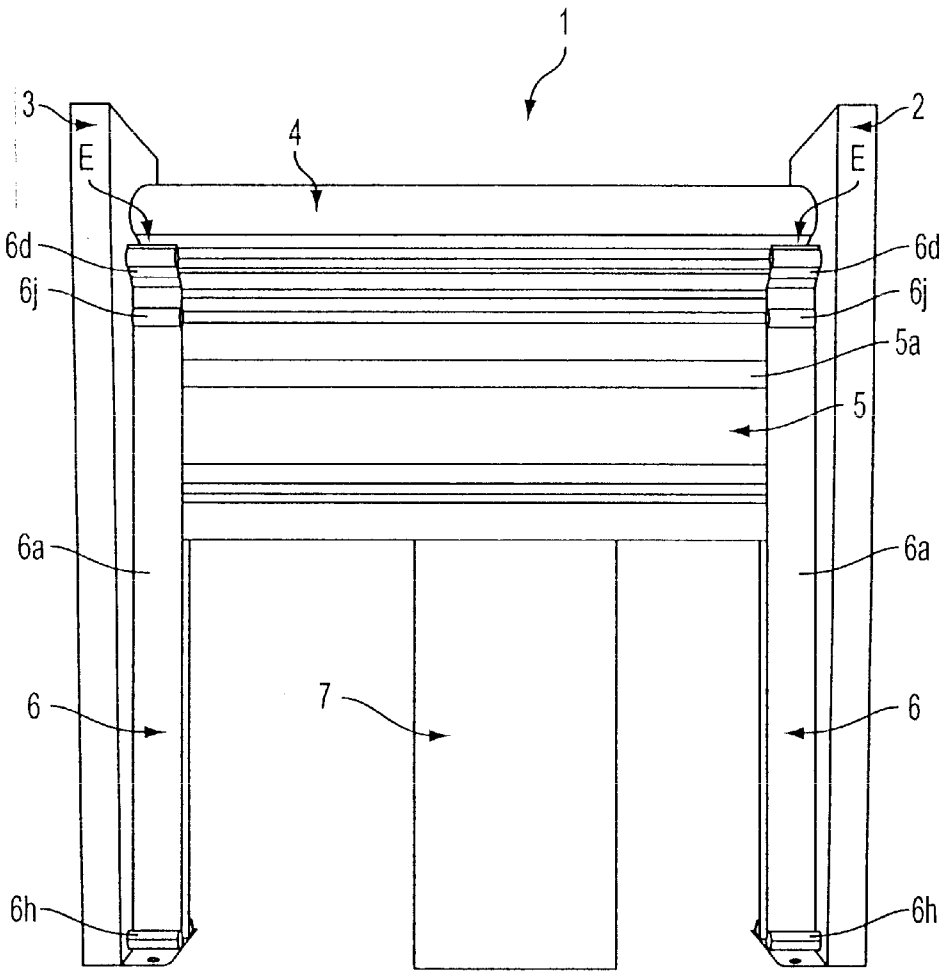
FIG. 3 shows a view similar to that of FIG. 1, but showing the flexible curtain of the door hindered in its movements by an obstacle.
Figure 4:
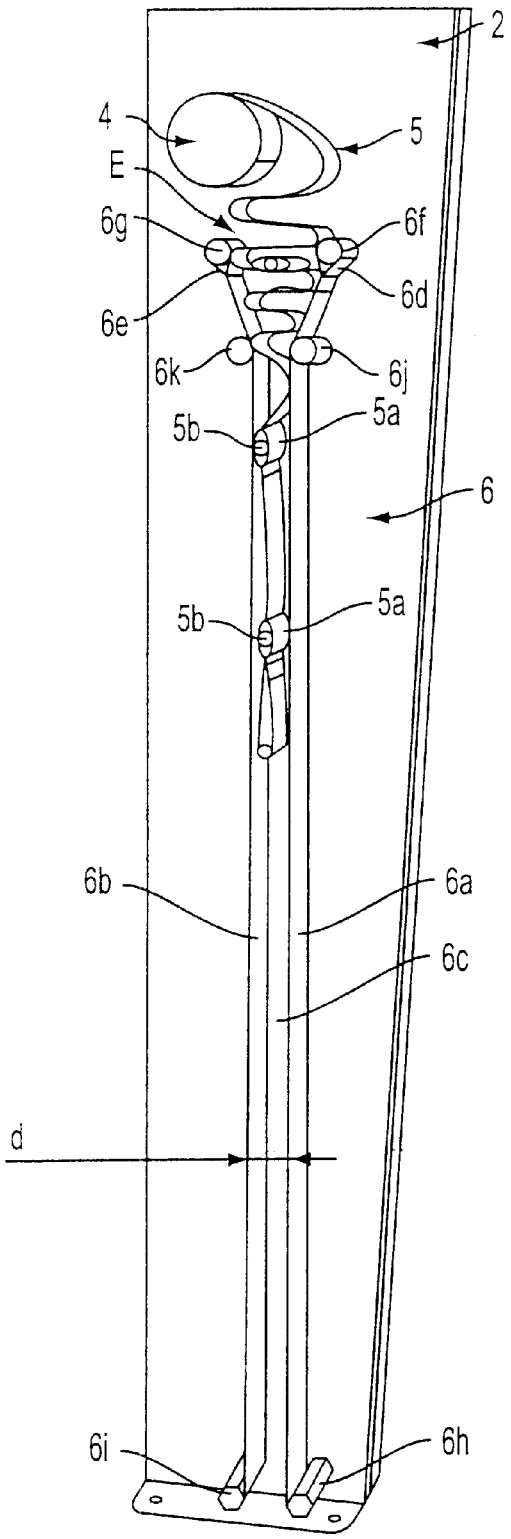
FIG. 4 shows a view similar to that of FIG. 2, but showing the unwinding of the flexible curtain at the upper end of the guidance device according to the invention, when the curtain is blocked in its descent by an obstacle.

FIGS. 3 and 4 show the flexible curtain 5 of the roll-up door 1 which is blocked in its descent by an obstacle 7. Under these conditions the curtain 5 continues to unwind and is accommodated in space E of the guidance device 6. It is then only necessary to reverse the rotation of the drum 4 to roll the curtain 5 up again.

Figure 5:
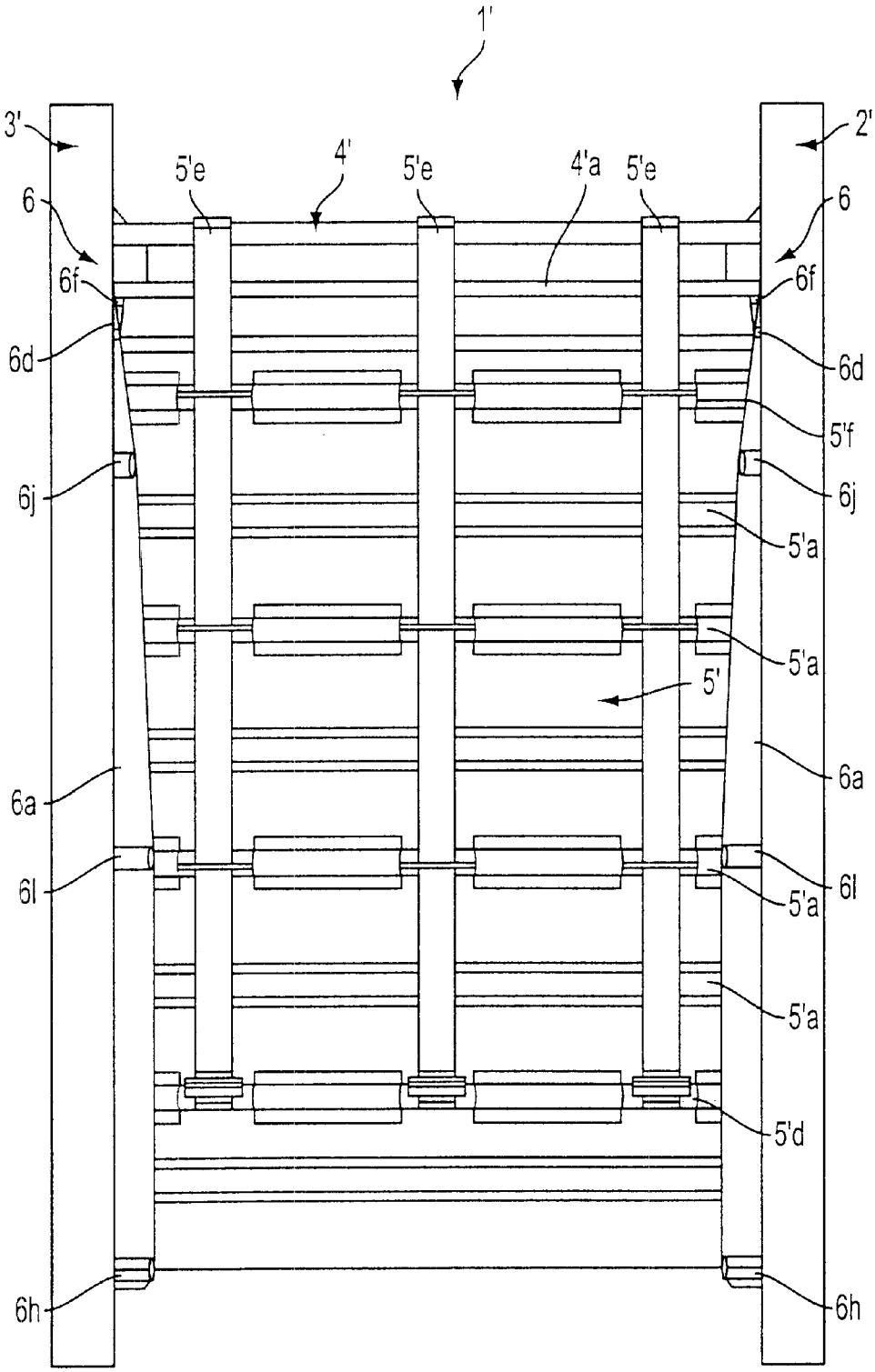
FIG. 5 shows a front view showing a flexible concertina-style curtain door, according to this invention, in the closed position.
Figure 6:
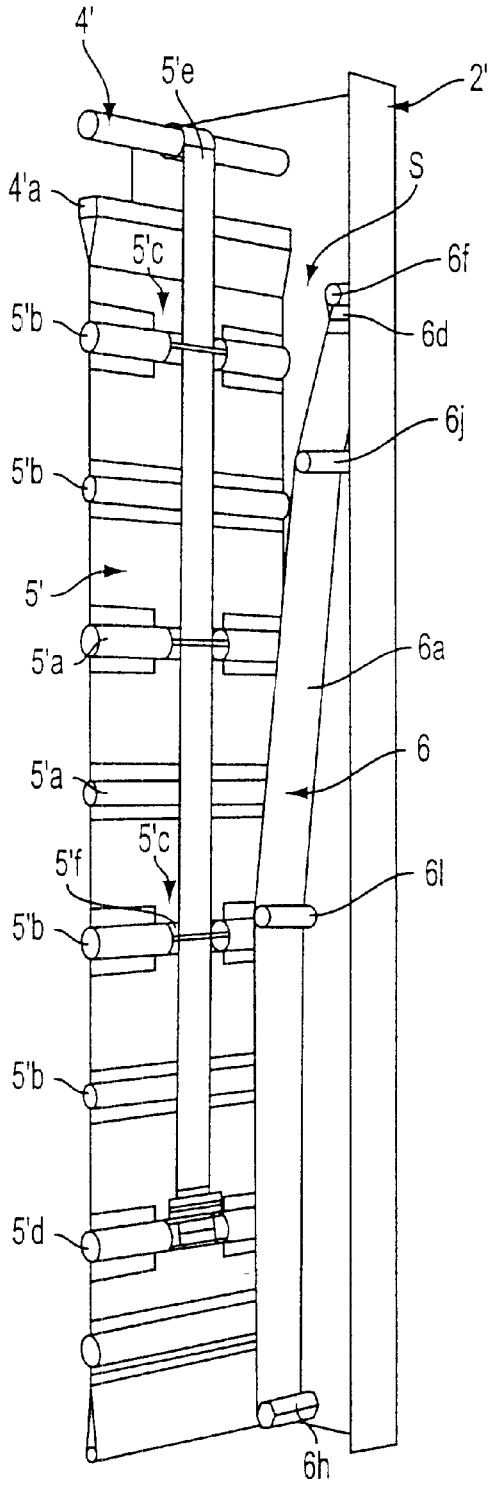
FIG. 6 shows a perspective view of a jamb of the door in FIG. 5, fitted with the guidance device according to the invention in the closed position.
Figure 8:
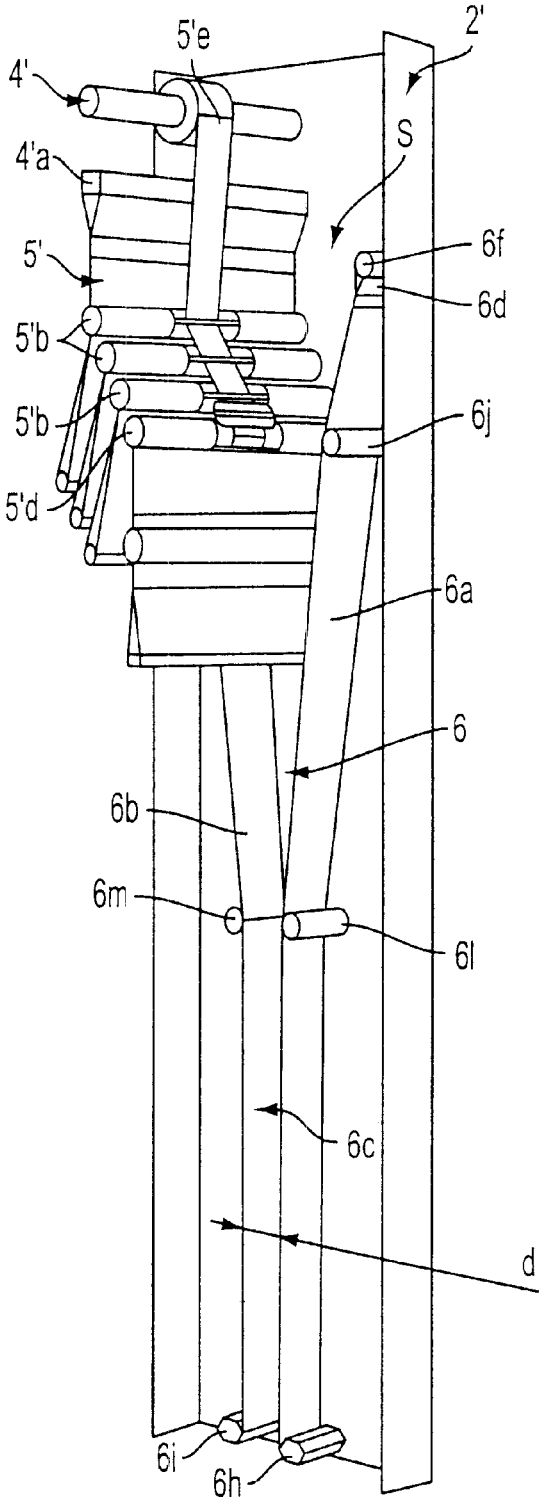
FIG. 8 shows a perspective view showing one of the jambs of the door in FIG. 7, fitted with the guidance device according to the invention in the open position.

FIGS. 5 and 8 show a concertina-style door 1'with two lateral jambs 2' and 3' which are fixed against the vertical walls of an opening to be closed off.

The opposite and vertical jambs 2' and 3' are linked together at the top of the door 1' by a winding drum 4' and a transverse fixed bar 4'*a* on which is held a flexible curtain 5'.

Jambs 2' and 3' are integral with a guidance device 6 similar. to that described above for the roll-up door 1. The guidance device 6 has a slideway 6*c* for guiding the flexible curtain 5' when it moves between a closed position and an open position.

The flexible curtain 5' has sleeves 5'*a* with openings 5'*c* for passage of horizontal reinforcing cross-pieces 5'*b*. The flexible curtain 5' has another horizontal cross-piece 5'*d* at the bottom which is linked by pulling straps 5'*e* to the winding drum 4'. The straps 5'*e* are guided at each horizontal reinforcing cross-piece 5'*b* via strap carriers 5'*f* arranged in the openings 5'*c* of the sleeves 5'*a*. Sleeves 5'*a* without openings are also provided, in which other reinforcing cross-pieces 5'*b* are inserted.

The drive system for the curtain 5' described above allows it to fold up, as it is opened in the upper part of the door 1'.

For the sake of clarity and understanding, only the guidance device 6 on iamb 2' will be described, since the other fitted on jamb 3' is identical. Moreover it is mainly the new and additional parts of the guidance device 6 not used in the roll-up door 1 which will be described here.

Thus the straps 6*a* and 6*b* with their loops 6*b* and 6*c* are fixed and stretched between two end points built into the jamb 2', that is between the pins 6*f*, 6*g* and the tensioners 6*h*, 6*i*.

Each strap 6*a* and 6*b* is supported between the pins 6*f*, 6*g* and the tensioners 6*h*, 6*i* on a first upper stop 6*j*, 6*k* and on a second midway stop 6*l*, 6*m*.

The straps 6*a*, 6*b* include between pins 6*f*, 6*g* and stops 6*j*, 6*k* an initial slope which is extended by a second slope at a different angle between stops 6*j*, 6*k* and midway stops 6*l*, 6*m*.

Figure 7:
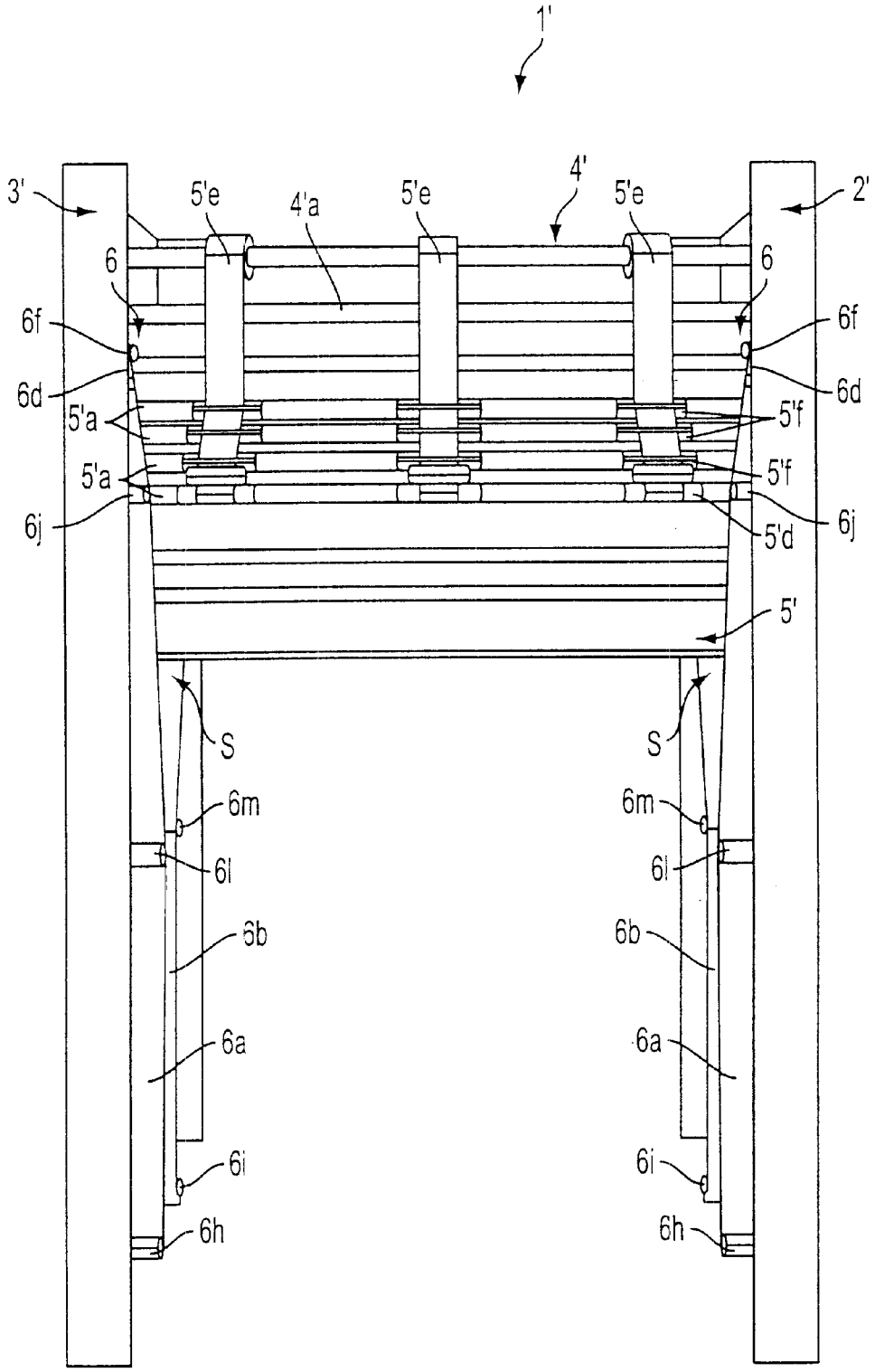
FIG. 7 shows a front view of the door in FIG. 5 in the open position.

This configuration allows the straps 6*a* and 6*b* to mark out a graduated opening space S to take the folds of the flexible curtain 5' as it opens (FIGS. 7 and 8).

The straps 6*a* and 6*b* have, in the extension of the space S, a straight vertical part. so that the said straps are parallel with each other to guide the flexible curtain 5' in its movements.

It will be noted that the guidance devices 6 built Into the jambs 2, 2' and 3, 3' of the doors 1, 1' are accessible without being dismantled and are easy to clean when the doors are intended for use in a food handling environment.

In addition, the guidance devices 6 fitted on the doors 1 and 1' have straps 6*a* and 6*b* whose width depends on that of curtain 5, 5' to be moved.

The guidance devices 6 have, between two straps 6*a*, 6*b* on one jamb of the door, and especially in the straight vertical part of these, a distance d close to that of the thickness of the flexible curtain 5, 5'.

It will be observed that the guidance devices 6 have straps 6*a*, 6*b*, each of which is able, when subjected to external force, to deform elastically, on the one hand around its vertical axis and on the other perpendicularly to its vertical axis, and to return undamaged to its original position.

This is because the relative elastic deformation of the straps 6*a*, 6*b* when the flexible curtain 5, 5' is blocked, or a lateral impact occurs, allows the horizontal cross-pieces to move out of position without risk of damage to the cross-pieces or to the straps.

In addition, the guidance device 6 reduces operating noise since there is no metal-to-metal contact, such as occurs on other doors.

What is claimed is:

1. A device for guiding a curtain in an opening, the device comprising:

a first guideway mounted directly to a first jamb adjacent the opening;

the first guideway comprising a space adapted to receive a portion of the curtain and at least one strap which is arranged between at least two points on the first jamb;

a second guideway mounted to a second jamb adjacent the opening;

the second guideway comprising a space adapted to receive a portion of the curtain and at least one strap which is arranged between at least two points on the second jamb, wherein the first and second guideways flexibly guide the curtain within the space of the guideways.

2. The device of claim 1, wherein at least one of the straps is oriented generally vertically.

3. The device of claim 1, wherein at least one of the straps is adapted to deform elastically and return undamaged to an original position.

4. The device of claim 1, wherein at least one of the straps is adapted to deform elastically perpendicularly to one of a corresponding first and second jambs and to return to an original position.

5. The device of claim 1, wherein at least one of the straps comprises an elastic strap.

6. The device of claim 1, wherein at least one of the straps is stretched between the at least two points.

7. The device of claim 1, wherein at least one of the first and second guideways is adapted to guide side portions of the curtain within the space of the respective first and second guideways.

8. A device for guiding a curtain in an opening, the device comprising:

a first guideway mounted directly to an inside surface of a first jamb adjacent the opening;

the first guideway comprising at least two members defining a space therebetween and adapted to receive a portion of the curtain;

at least one of the two members of the first guideway comprising a strap;

a second guideway mounted directly to an inside surface of a second jamb adjacent the opening;

the second guideway comprising at least two members defining a space therebetween and adapted to receive a side portion of the curtain;

at least one of the two members of the second guideway comprising a strap;

wherein the first and second guideways flexibly guide side portions of the curtain within the space of the guideways.

9. The device of claim 8, wherein each of the straps is generally vertically oriented and is adapted to deform elastically and return undamaged to an original position.

10. The device of claim 8, wherein each of the straps is adapted to deform elastically perpendicularly to one of the first and second jambs.

11. The device of claim 8, wherein each of the straps is stretched between at least two points mounted to each corresponding first and second jambs.

12. The device of claim 8, wherein each of the straps is stretched between at least two points on corresponding first and second jambs.

13. A device for guiding a curtain in an opening, the curtain including at least one horizontal cross piece with opposed ends, the device comprising:

a first guideway mounted directly to a first vertical jamb adjacent the opening;

the first guideway comprising a space adapted to receive an end of the horizontal cross piece and at least one strap arranged between at least two points on the first vertical jamb;

a second guideway mounted directly to a second vertical jamb adjacent the opening;

the second guideway comprising a space adapted to receive an end of the horizontal cross piece and at least one strap arranged between at least two points on the second vertical jamb;

wherein the first and second guideways flexibly guide the ends of the at least one horizontal cross piece within the space of the guideways.

14. The device of claim 13, wherein each of the straps has an original position corresponding to a vertical axis, and, when subjected to external force, each is able to deform elastically with respect to the vertical axis and to return undamaged to the original position.

15. The device of claim 14, wherein, when subjected to an external force, each of the straps is able to deform elastically perpendicularly to the vertical axis, and return undamaged to the original position.

16. The device of claim 13, wherein each of the straps comprises an elastic strap.

17. The device of claim 13, wherein each strap is stretched between at least two points on the first and second jambs.

18. A device for guiding a curtain in an opening, the curtain including at least one horizontal cross piece with opposed ends, the device comprising:

a first guideway mounted directly to an inside surface of a first jamb adjacent the opening;

the first guideway comprising at least two members defining a space therebetween and adapted to receive a portion of the curtain;

at least one of the two members of the first guideway comprising a strap;

a second guideway mounted directly to an inside surface of a second jamb adjacent the opening;

the second guideway comprising at least two members defining a space therebetween and adapted to receive a side portion of the curtain;

at least one of the two members of the second guideway comprising a strap;

wherein the first and second guideways flexibly guide the ends of the at least one horizontal cross piece within the space of the guideways.

19. The device of claim 18, wherein each of the straps is generally vertically oriented and is adapted to deform elastically and return undamaged to an original position.

20. The device of claim 18, wherein each of the straps is adapted to deform elastically perpendicularly to one of the first and second jambs.

21. The device of claim 18, wherein each of the straps is stretched between at least two points mounted to each corresponding first and second jambs.

22. The device of claim 18, wherein each of the straps comprises a strap which is stretched between at least two points on corresponding first and second jambs.

23. A curtain door comprising:

a curtain adapted to move within a door opening;

a first guideway mounted directly to a first jamb adjacent the door opening;

the first guideway including a space adapted to receive a portion of the curtain, and comprising at least one strap;

a second guideway mounted directly to a second jamb adjacent the door opening;

the second guideway including a space adapted to receive a portion of the curtain, and comprising at least one strap;

wherein the first and second guideways are each adapted to flexibly guide the curtain within the door opening.

24. The device of claim 23, wherein at least one of the straps is oriented generally vertically.

25. The device of claim 23, wherein at least one of the straps is adapted to deform elastically and return undamaged to an original position.

26. The device of claim 25, wherein the at least one strap is adapted to deform elastically perpendicularly to one of the first and second jambs and an axis defined between at least two points on one of the first and second jambs.

27. The device of claim 23, wherein each of the straps is adapted to be stretched between the at least two points on corresponding first and second jambs.

28. The device of claim 23, wherein each of the straps is adapted to guide side portions of the curtain in the door opening.

29. The device of claim 23, wherein each of the straps is oriented generally vertically and wherein each of the straps is adapted to deform elastically and return undamaged to an original position.

30. A curtain door comprising:

a curtain including side portions and being movable within an opening;

a first guideway mounted directly to an inside surface of a first vertical jamb adjacent the opening;

the first guideway comprising at least two members defining a space therebetween and adapted to receive a side portion of the curtain;

at least one of the two members of the first guideway comprising a strap;

a second guideway mounted directly to an inside surface of a second vertical jamb adjacent the opening;

the second guideway comprising at least two members defining a space therebetween and adapted to receive a side portion of the curtain;

at least one of the two members of the second guideway comprising a strap;

wherein the first and second guideways are each adapted to flexibly guide the side portions of the curtain within the opening.

31. The curtain door of claim 30, wherein each of the straps is adapted to deform elastically and return undamaged to an original position.

32. The curtain door of claim 31, wherein, when subjected to an external force, each of the straps is able to deform elastically perpendicularly to one of the first and second jambs, and return undamaged to the original position.

33. The curtain door of claim 30, wherein each of the straps has an original position which corresponds to a vertical axis, and, when subjected to external force, each is able to deform elastically perpendicularly to the vertical axis and to return undamaged to an original position.

34. A curtain door comprising:

a curtain, including at least one horizontal cross piece with opposed ends, adapted to move within a door opening;

a first guideway mounted directly to a first jamb adjacent the door opening;

the first guideway including a space adapted to receive a portion of the curtain, and comprising at least one strap;

a second guideway mounted directly to a second jamb adjacent the door opening;

the second guideway including a space adapted to receive a portion of the curtain, and comprising at least one strap;

wherein the first and second guideways are each adapted to flexibly guide the curtain within the door opening.

35. The device of claim 34, wherein at least one of the straps is oriented generally vertically.

36. The device of claim 34, wherein at least one of the straps is adapted to deform elastically and return undamaged to an original position.

37. The device of claim 36, wherein the at least one strap is adapted to deform elastically perpendicularly to one of the first and second jambs and an axis defined between at least two points on one of the first and second jambs.

38. The device of claim 34, wherein each of the straps is adapted to be stretched between at least two points on corresponding first and second jambs.

39. The device of claim 34, wherein each of the straps is adapted to guide side portions of the curtain in the door opening.

40. The device of claim 34, wherein each of the straps is oriented generally vertically and wherein each of the straps is adapted to deform elastically and return undamaged to an original position.

41. A curtain door comprising:

a curtain including at least one horizontal cross piece with opposed ends;

a first guideway mounted directly to an inside surface of a first vertical jamb adjacent the opening;

the first guideway comprising at least two members defining a space therebetween and adapted to receive an end of the horizontal cross piece;

at least one of the two members of the first guideway comprising a strap;

a second guideway mounted directly to an inside surface of a second vertical jamb adjacent the opening;

the second guideway comprising at least two members defining a space therebetween and adapted to receive an end of the horizontal cross piece;

at least one of the two members of the second guideway comprising a strap;

wherein the first and second guideways are each adapted to flexibly guide an end of the horizontal cross piece within the opening.

42. The curtain door of claim 41, wherein each of the straps has an original position corresponding to a vertical axis, and, when subjected to external force, each is able to deform elastically around the vertical axis and to return undamaged to the original position.

43. The curtain door of claim 42, wherein, when subjected to an external force, each of the straps is able to deform elastically perpendicularly to the vertical axis, and return undamaged to the original position.

44. The curtain door of claim 41, wherein each of the straps has an original position corresponding to a vertical axis, and, when subjected to external force, each is able to deform elastically perpendicularly to the vertical axis and to return undamaged to the original position.

45. A device for guiding a curtain in an opening, the device comprising:

a first guideway mounted to a first jamb adjacent the opening;

the first guideway comprising a space adapted to receive a portion of the curtain and at least one elastically deformable member which is arranged between at least two points on the first jamb;

a second guideway mounted to a second jamb adjacent the opening;

the second guideway comprising a space adapted to receive a portion of the curtain and at least one elastically deformable member which is arranged between at least two points on the second jamb, wherein the first and second guideways flexibly guide the curtain within the space of the guideways, and wherein at least one of the elastically deformable members comprises a strap.

46. The device of claim 45, wherein the strap is adapted to deform elastically perpendicularly to one of a corresponding first and second jambs and to return to an original position.

47. A device for guiding a curtain in an opening, the device comprising:

a first guideway mounted to a first jamb adjacent the opening;

the first guideway comprising a space adapted to receive a portion of the curtain and at least one elastically deformable member which is arranged between at least two points on the first jamb;

a second guideway mounted to a second jamb adjacent the opening;

the second guideway comprising a space adapted to receive a portion of the curtain and at least one elastically deformable member which is arranged between at least two points on the second jamb, wherein the first and second guideways flexibly guide the curtain within the space of the guideways, and wherein at least one of the elastically deformable members is stretched between the at least two points.

48. The device of claim 47, wherein the at least one of the elastically deformable members is adapted to deform elastically perpendicularly to one of a corresponding first and second jamb and to return to an original position.

49. A device for guiding a curtain in an opening, the device comprising:

a first guideway mounted to a first jamb adjacent the opening;

the first guideway comprising at least two members defining a space therebetween and adapted to receive a portion of the curtain;

at least one of the two members of the first guideway being an elastically deformable member arranged between at least two points on the first jamb;

a second guideway mounted to a second jamb adjacent the opening;

the second guideway comprising at least two members defining a space therebetween and adapted to receive a side portion of the curtain;

at least one of the two members of the second guideway being an elastically deformable member arranged between at least two points on the second jamb;

wherein the first and second guideways flexibly guide side portions of the curtain within the space of the guideways, and wherein at least one of the elastically deformable members is stretched between at least two points on corresponding first and second jambs.

50. The device of claim 49, wherein the at least one of the elastically deformable members is adapted to deform elastically perpendicularly to a corresponding one of the first and second jambs.

51. A device for guiding a curtain in an opening, the device comprising:

a first guideway mounted to a first jamb adjacent the opening;

the first guideway comprising at least two members defining a space therebetween and adapted to receive a portion of the curtain;

at least one of the two members of the first guideway being an elastically deformable member arranged between at least two points on the first jamb;

a second guideway mounted to a second jamb adjacent the opening;

the second guideway comprising at least two members defining a space therebetween and adapted to receive a side portion of the curtain;

at least one of the two members of the second guideway being an elastically deformable member arranged between at least two points on the second jamb;

wherein the first and second guideways flexibly guide side portions of the curtain within the space of the guideways, and wherein at least one of the elastically deformable members comprises a strap which is stretched.

52. The device of claim 51, wherein the strap is adapted to deform elastically perpendicularly to a corresponding one of the first and second jambs.

53. A device for guiding a curtain in an opening, the curtain including at least one horizontal cross piece with opposed ends, the device comprising:

a first guideway mounted to a first vertical jamb adjacent the opening;

the first guideway comprising a space adapted to receive an end of the horizontal cross piece and at least one elastically deformable member arranged between at least two points on the first vertical jamb;

a second guideway mounted to a second vertical jamb adjacent the opening;

the second guideway comprising a space adapted to receive an end of the horizontal cross piece and at least one elastically deformable member arranged between at least two points on the second vertical jamb;

wherein the first and second guideways flexibly guide the ends of the at least one horizontal cross piece within the space of the guideways, and wherein at least one of the elastically deformable members comprises a strap.

54. The device of claim 53, wherein each of the elastically deformable members has an original position corresponding to a vertical axis, and, when subjected to external force, each is deformable elastically with respect to the vertical axis to return undamaged to the original position.

55. The device of claim 54, wherein, when subjected to an external force, each of the elastically deformable members is deformable elastically perpendicularly to the vertical axis to return undamaged to the original position.

56. A device for guiding a curtain in an opening, the curtain including at least one horizontal cross piece with opposed ends, the device comprising:

a first guideway mounted to a first vertical jamb adjacent the opening;

the first guideway comprising a space adapted to receive an end of the at least one horizontal cross piece and at least one elastically deformable member arranged between at least two points on the first vertical jamb;

a second guideway mounted to a second vertical jamb adjacent the opening;

the second guideway comprising a space adapted to receive an end of the horizontal cross piece and at least one elastically deformable member arranged between at least two points on the second vertical jamb;

wherein the first and second guideways flexibly guide the ends of the at least one horizontal cross piece within the space of the guideways, and wherein at least one of the elastically deformable members is stretched between at least two points on the first and second jambs.

57. The device of claim 56, wherein each of the elastically deformable members has an original position corresponding to a vertical axis, and, when subjected to external force, each is deformable elastically with respect to the vertical axis to return undamaged to the original position.

58. The device of claim 57, wherein, when subjected to an external force, each of the elastically deformable members is deformable elastically perpendicularly to the vertical axis to return undamaged to the original position.

59. A device for guiding a curtain in an opening, the curtain including at least one horizontal cross piece with opposed ends, the device comprising:

a first guideway mounted to a first vertical jamb adjacent the opening;

the first guideway comprising at least two members defining a space therebetween and adapted to receive an end of the at least one horizontal cross piece;

at least one of the two members of the first guideway comprising an elastically deformable member arranged between at least two points on the first vertical jamb;

a second guideway mounted to a second vertical jamb adjacent the opening;

the second guideway comprising at least two members defining a space therebetween and adapted to receive an end of the at least one horizontal cross piece;

at least one of the two members of the second guideway comprising an elastically deformable member arranged between at least two points on the second vertical jamb;

wherein the first and second guideways flexibly guide the ends of the at least one horizontal cross piece within the space of the guideways within the door opening, and wherein each of the elastically deformable members comprises a strap.

60. The device of claim 59, wherein each of the elastically deformable members has an original position corresponding to a vertical axis, and, when subjected to external force, each is deformable elastically with respect to the vertical axis to return undamaged to the original position.

61. The device of claim 60, wherein, when subjected to an external force, each of the elastically deformable members is deformable elastically perpendicularly to the vertical axis to return undamaged to the original position.

62. A device for guiding a curtain in an opening, the curtain including at least one horizontal cross piece with opposed ends, the device comprising:

a first guideway mounted to a first vertical jamb adjacent the opening;

the first guideway comprising at least two members defining a space therebetween and adapted to receive an end of the at least one horizontal cross piece;

at least one of the two members of the first guideway comprising an elastically deformable member arranged between at least two points on the first vertical jamb;

a second guideway mounted to a second vertical jamb adjacent the opening;

the second guideway comprising at least two members defining a space therebetween and adapted to receive an end of the at least one horizontal cross piece;

at least one of the two members of the second guideway comprising an elastically deformable member arranged between at least two points on the second vertical jamb;

wherein the first and second guideways flexibly guide the ends of the horizontal cross piece within the space of the guideways within the door opening, and wherein at least one of the elastically deformable members is stretched between the at least two points.

63. The device of claim 62, wherein each of the elastically deformable members has an original position corresponding to a vertical axis, and, when subjected to external force, each is deformable elastically with respect to the vertical axis to return undamaged to the original position.

64. The device of claim 63, wherein, when subjected to an external force, each of the elastically deformable members is able to deform elastically perpendicularly to the vertical axis, and return undamaged to the original position.

65. A device for guiding a curtain in a door opening, the curtain including opposed side portions and being movable generally vertically between at least a blocked position and at least an unblocked position relative to the door opening which includes vertical edges, the device comprising:

at least two members extending generally vertically and defining a space therebetween and being mountable adjacent a vertical edge of the door opening;

the space being adapted to receive a side portion of the curtain such that the two members guide the curtain between the blocked and unblocked positions;

at least one of the two members having an original position and comprising an elastically deformable strap so as to deform and allow the side portion of the curtain to escape from the space upon application of a lateral impact on the curtain, and to return undamaged to the original position.

66. The device of claim 65, wherein each of the two members comprises an elastically deformable strap.

67. The device of claim 65, wherein the original position corresponds to a vertical axis, and when the strap is subjected to an external force, it is deformable elastically around the vertical axis to return undamaged to the original position.

68. The device of claim 67, wherein when the strap is subjected to an external force, it is deformable elastically perpendicularly to the vertical axis to return undamaged to the original position.

69. A device for guiding a curtain in a door opening, the curtain including at least one horizontal cross piece with opposed ends, the curtain being movable generally vertically between at least blocking and unblocking positions relative to the door opening which includes vertical edges, the device comprising:

at least two members extending generally vertically and mountable adjacent a vertical edge of the door opening;

the at least two members being disposed to provide a space therebetween;

the space being adapted to receive an end of the at least one horizontal cross piece to guide the curtain between at least the blocking and the unblocking positions;

at least one of the two members having an original position and being an elastically deformable strap so as to deform and allow the end of the at least one horizontal cross piece to escape from the space upon application of a lateral impact on the curtain, and to return undamaged to the original position.

70. The device of claim 69, wherein each of the two members comprises an elastically deformable strap.

71. The device of claim 69, wherein the original position corresponds to a vertical axis, and when the strap is subjected to an external force, it is deformable elastically around the vertical axis to return undamaged to the original position.

72. The device of claim 71, wherein when the strap is subjected to an external force, it is deformable elastically perpendicularly to the vertical axis to return undamaged to the original position.

73. A device for guiding a door, the door including opposed side portions and being movable generally vertically between at least blocking and unblocking positions relative to a door opening including vertical edges, the device comprising:

at least two members extending generally vertically and mountable adjacent a vertical edge of the door opening and which are disposed to provide a space therebetween, the space being adapted to receive a side portion of the door such that the members guide the door between at least the blocking and the unblocking positions;

at least one of the members having an original position and being an elastically deformable strap so as to deform and allow the side portion of the door to escape from the space upon application of a lateral impact on the door, and to return undamaged to an original position.

74. The device of claim 73, wherein each of the two members comprises an elastically deformable strap.

75. The device of claim 73, wherein the original position corresponds to a vertical axis, and when the strap is subjected to an external force, it is deformable elastically around the vertical axis to return undamaged to the original position.

76. The device of claim 75, wherein when the strap is subjected to an external force, it is deformable elastically perpendicularly to the vertical axis to return undamaged to the original position.

77. A curtain door utilizing a guidance device for guiding a flexible curtain in an opening, the curtain including side portions and being movable within the opening, the curtain door comprising:

a first guideway mounted to a first vertical jamb adjacent the opening;

the first guideway including a space adapted to receive a portion of the flexible curtain, and comprising at least a first elastically deformable member arranged between at least two points on the first vertical jamb;

a second guideway mounted to a second vertical jamb adjacent the opening;

the second guideway including a space adapted to receive a portion of the flexible curtain, and comprising at least a second elastically deformable member arranged between at least two points on the second vertical jamb, wherein the first and second guideways are each adapted to flexibly guide the flexible curtain within the opening, and wherein at least one of the at least a first elastically deformable member and at least a second elastically deformable member comprises a strap.

78. The curtain door of claim 77, wherein the strap has an original position corresponding to a vertical axis, and, when subjected to external force, the strap is able to deform elastically around the vertical axis and to return undamaged to the original position.

79. The curtain door of claim 78, wherein, when subjected to an external force, the strap is deformable elastically perpendicularly to the vertical axis to return undamaged to the original position.

80. A curtain door utilizing a guidance device for guiding a flexible curtain in an opening, the curtain including side portions and being movable within the opening, the curtain door comprising:

a first guideway mounted to a first vertical jamb adjacent the opening;

the first guideway including a space adapted to receive a portion of the flexible curtain, and comprising at least a first elastically deformable member arranged between at least two points on the first vertical jamb;

a second guideway mounted to a second vertical jamb adjacent the opening;

the second guideway including a space adapted to receive a portion of the flexible curtain, and comprising at least a second elastically deformable member arranged between at least two points on the second vertical jamb, wherein the first and second guideways are each adapted to flexibly guide the flexible curtain within the opening, and wherein at least one of the first elastically deformable member and the second deformable member is stretched between the at least two points.

81. The curtain door of claim 79, wherein the stretched elastically deformable member has an original position corresponding to a vertical axis, and, when subjected to external force, the stretched deformable member being deformable elastically around the vertical axis to return undamaged to the original position.

82. The curtain door of claim 81, wherein, when subjected to an external force, the stretched deformable member is deformable elastically perpendicularly to the vertical axis, to return undamaged to the original position.

83. A curtain door utilizing a guidance device for guiding a curtain in an opening, the curtain including side portions and being movable within the opening, the curtain door comprising:

a first guideway mounted to a first vertical jamb adjacent the opening;

the first guideway comprising at least two members defining a space therebetween and adapted to receive a side portion of the curtain;

at least one of the at least two members of the first guideway comprising an elastically deformable member arranged between at least two points on the first vertical jamb;

a second guideway mounted to a second vertical jamb adjacent the opening;

the second guideway comprising at least two members defining a space therebetween and adapted to receive a side portion of the curtain;

at least one of the at least two members of the second guideway comprising an elastically deformable member arranged between at least two points on the second vertical jamb;

wherein the first and second guideways are each adapted to flexibly guide the side portions of the flexible curtain within the opening, and wherein at least one of the elastically deformable members is stretched between the at least two points.

84. The curtain door of claim 83, wherein the stretched elastically deformable member has an original position corresponding to a vertical axis, and, when subjected to external force, the stretched elastically deformable member is deformable elastically around the vertical axis to return undamaged to the original position.

85. The curtain door of claim 84, wherein, when subjected to an external force, the elastically deformable member is deformable elastically perpendicularly to the vertical axis to return undamaged to the original position.

86. A curtain door utilizing a guidance device for guiding a curtain in an opening, the curtain door comprising:

a curtain including side portions and being movable within the opening;

a first guideway mounted to a first vertical jamb adjacent the opening;

the first guideway comprising at least two members defining a space therebetween and adapted to receive a side portion of the curtain;

at least one of the two members of the first guideway comprising an elastically deformable member arranged between at least two points on the first vertical jamb;

a second guideway mounted to a second vertical jamb adjacent the opening;

the second guideway comprising at least two members defining a space therebetween and adapted to receive a side portion of the curtain;

at least one of the two members of the second guideway comprising an elastically deformable member arranged between at least two points on the second vertical jamb;

wherein the first and second guideways are each adapted to flexibly guide the side portions of the flexible curtain within the opening, wherein at least one of the elastically deformable members is stretched between the at least two points.

87. The curtain door of claim 86, wherein the stretched elastically deformable member has an original position corresponding to a vertical axis, and, when subjected to external force, the stretched deformable member is deformable elastically around the vertical axis to return undamaged to the original position.

88. The curtain door of claim 87, wherein, when subjected to an external force, the stretched deformable member is deformable elastically perpendicularly to the vertical axis to return undamaged to the original position.

89. A curtain door utilizing a guidance device for guiding a curtain in an opening, the curtain including at least one horizontal cross piece with opposed ends, the curtain door comprising:

a first guideway for mounting to a first vertical jamb adjacent the opening;

the first guideway including a space adapted to receive an end of the at least one horizontal cross piece, and comprising at least one elastically deformable member arranged between at least two points on the first vertical jamb;

a second guideway for mounting to a second vertical jamb adjacent the opening;

the second guideway including a space adapted to receive an end of the at least one horizontal cross piece, and comprising at least one elastically deformable member arranged between at least two points on the second vertical jamb;

wherein the first and second guideways are each adapted to flexibly guide an end of the at least one horizontal cross piece within the opening, and wherein at least one of the elastically deformable members is stretched between the at least two points.

90. The curtain door of claim 89, wherein the stretched elastically deformable member has an original position corresponding to a vertical axis, and, when subjected to external force, the stretched elastically deformable member is deformable elastically around the vertical axis to return undamaged to the original position.

91. The curtain door of claim 90, wherein, when subjected to an external force, the elastically deformable member is deformable elastically perpendicularly to the vertical axis to return undamaged to the original position.

92. A curtain door utilizing a guidance device for guiding a curtain in an opening, the curtain including at least one horizontal cross piece with opposed ends, the curtain door comprising:

a first guideway for mounting to a first vertical jamb adjacent the opening;

the first guideway including a space adapted to receive an end of the at least one horizontal cross piece, and comprising at least one elastically deformable member arranged between at least two points on the first vertical jamb;

a second guideway for mounting to a second vertical jamb adjacent the opening;

the second guideway including a space adapted to receive an end of the at least one horizontal cross piece, and comprising at least one elastically deformable member arranged between at least two points on the second vertical jamb;

wherein the first and second guideways are each adapted to flexibly guide an end of the at least one horizontal cross piece within the opening, wherein at least one of the elastically deformable members is stretched between the at least two points.

93. The curtain door of claim 92, wherein the stretched elastically deformable member has an original position corresponding to a vertical axis, and, when subjected to external force, the stretched deformable member is deformable elastically around the vertical axis to return undamaged to the original position.

94. The curtain door of claim 93, wherein, when subjected to an external force, the stretched deformable member is deformable elastically perpendicularly to the vertical axis to return undamaged to the original position.

95. A curtain door utilizing a guidance device for guiding a curtain in an opening, the curtain including at least one horizontal cross piece with opposed ends, the curtain door comprising:

a first guideway for mounting to a first vertical jamb adjacent the opening;

the first guideway comprising at least two members defining a space therebetween and adapted to receive an end of the at least one horizontal cross piece;

at least one of the two members of the first guideway being an elastically deformable member arranged between at least two points on the first vertical jamb;

a second guideway for mounting to a second vertical jamb adjacent the opening;

the second guideway comprising at least two members defining a space therebetween and adapted to receive an end of the at least one horizontal cross piece;

at least one of the two members of the second guideway being an elastically deformable member arranged between at least two points on the second vertical jamb;

wherein the first and second guideways are each adapted to flexibly guide an end of the at least one horizontal cross piece within the opening, and wherein at least one of the elastically deformable members is stretched between the at least two points.

96. The curtain door of claim 95, wherein the stretched elastically deformable member has an original position corresponding to a vertical axis, and, when subjected to external force, the stretched elastically deformable member is deformable elastically around the vertical axis to return undamaged to the original position.

97. The curtain door of claim 96, wherein, when subjected to an external force, the elastically deformable member is deformable elastically perpendicularly to the vertical axis to return undamaged to the original position.

98. A curtain door utilizing a guidance device for guiding a curtain in an opening, the curtain including at least one horizontal cross piece with opposed ends, the curtain door comprising:

a first guideway for mounting to a first vertical jamb adjacent the opening;

the first guideway comprising at least two members defining a space therebetween and adapted to receive an end of the at least one horizontal cross piece;

at least one of the two members of the first guideway comprising an elastically deformable member arranged between at least two points on the first vertical jamb;

a second guideway for mounting to a second vertical jamb adjacent the opening;

the second guideway comprising at least two members defining a space therebetween and adapted to receive an end of the at least one horizontal cross piece;

at least one of the two members of the second guideway comprising an elastically deformable member arranged between at least two points on the second vertical jamb;

wherein the first and second guideways are each adapted to flexibly guide an end of the at least one horizontal cross piece within the opening, and wherein at least one of the elastically deformable members is stretched between the at least two points.

99. The curtain door of claim 98, wherein the stretched elastically deformable member has an original position corresponding to a vertical axis, and, when subjected to external force, the stretched deformable member is deformable elastically around the vertical axis to return undamaged to the original position.

100. The curtain door of claim 99, wherein, when subjected to an external force, the stretched deformable member is deformable elastically perpendicularly to the vertical axis to return undamaged to the original position.

101. A curtain door utilizing a guidance device for guiding a generally vertically movable curtain between at least a blocked position and an unblocked position relative to a door opening which includes vertical edges, the curtain door comprising:

at least two members extending generally vertically and mountable adjacent a vertical edge of the door opening and which are disposed to provide a space therebetween, the space being adapted to receive a side portion of the curtain to guide the curtain between the blocked and the unblocked positions;

at least one of the members having an original position and comprising an elastically deformable strap so as to deform and allow the side portion of the curtain to escape from the space upon application of a lateral impact on the curtain, and to return undamaged to the original position, wherein the curtain is movable within the door opening.

102. The device of claim 101, wherein each of the two members comprises an elastically deformable strap.

103. The device of claim 101, wherein the original position corresponds to a vertical axis, and when the elastically deformable strap is subjected to an external force, it is deformable elastically around the vertical axis to return undamaged to the original position.

104. The device of claim 103, wherein when the elastically deformable strap is subjected to an external force, it is deformable elastically perpendicularly to the vertical axis to return undamaged to the original position.

105. A curtain door utilizing a guidance device for guiding a curtain movable generally vertically between at least blocking and unblocking positions relative to a door opening including vertical edges, the curtain including at least one horizontal cross piece with opposed ends, the curtain door comprising:

at least two members extending generally vertically and mountable adjacent a vertical edge of the door opening and which are disposed to provide a space therebetween, the space being adapted to receive an end of the at least one horizontal cross piece to guide the curtain between at least the blocking and the unblocking positions;

at least one of the members having an original position and comprising an elastically deformable strap so as to deform and allow the end of the at least one horizontal cross piece to escape from the space upon application of a lateral impact on the curtain, to return undamaged to the original position.

106. The device of claim 105, wherein the original position corresponds to a vertical axis, and when the elastically deformable strap is subjected to an external force, it is deformable elastically around the vertical axis to return undamaged to the original position.

107. The device of claim 106, wherein when the elastically deformable strap is subjected to an external force, it is deformable elastically perpendicularly to the vertical axis to return undamaged to the original position.

* * * * *